US006151946A

United States Patent [19]

Fabris

[11] Patent Number: 6,151,946

[45] Date of Patent: Nov. 28, 2000

[54] ROLLER ENTRY GUIDE FOR ROD MILLS

[76] Inventor: Mario Fabris, 188 North Service Road, Grimsby, Ontario, Canada, L3M 4E8

[21] Appl. No.: 09/032,782

[22] Filed: Mar. 2, 1998

[51] Int. Cl.[7] ..... B21B 39/20

[52] U.S. Cl. ..... 72/250

[58] Field of Search ..... 72/250, 251, 227

[56] References Cited

U.S. PATENT DOCUMENTS 4,295,356 10/1981 Fabris ..... 72/227

4,373,367 2/1983 Fabris ..... 72/250

*Primary Examiner*—Rodney A. Butler

*Attorney, Agent, or Firm*—Edward H. Oldham

[57] ABSTRACT

A roller for a steel mill entry guide in which pockets are formed in at least one of the flat annular surfaces on the side of the roller. The pockets are used to intersect a stream of moving fluid projected at the surface of the roller containing the pockets to force the rollers to rotate whilst no work is passing through the guide. The pockets are of a rectangular shape and are easy to fabricate and have no preferential direction of rotation.

6 Claims, 2 Drawing Sheets

ROLLER ENTRY GUIDE FOR ROD MILLS

FIELD OF INVENTION

This invention is concerned with improving the performance of a roller entry guide used in steel mills for the facilitation of the passage of a steel billet from one roll stand to the next roll stand in a multi-stand roll reduction operation.

PRIOR ART

The operation of a multi-stand progressive reduction rolling mill is well known by those skilled in the art. In operation, a rod mill may have in excess of 25 stages where a heated metal billet having an initial cross section of 16–20 square inches is reduced to 40 thousandths of an inch in diameter during its passage through the mill. The velocity of the hot steel workpiece increases in direct proportion to the reduction in cross sectional area. Thus the exit speed of a typical rod being reduced, as described above, is 400 speed of a typical rod being reduced, as described above, is 400 times the entrance velocity of the billet which may approach 100 meters per second. Because the rod impinges on the next roller entry guide (and on the rollers mounted in the entry guide device) with considerable force and momentum, it is desirable to have the rollers in the entry guide device spinning at a speed equal to or slightly greater than the velocity of the rod entering the roller entry guide. This reduces the damage (known as front end pitting) done by the leading end of the swiftly moving rod as it is intercepted by the rollers in the entry guide device. If the rollers are not spinning upon the arrival of high speed rod end, skidding occurs between the roll and the rod which causes damage to the rollers in the entry guide. Damage to the bearings may also occur as the leading rod end repeatedly impacts the rollers in the roller entry guide.

It is common to have bearings in the roller entry guide damaged by the repeated impacting of the swiftly moving rod end so that the rollers rotate eccentrically as the rod passes therebetween to produce diameter deviations which impair the usefulness of the finished rod.

Steel mill builders are constantly endeavoring to increase the throughput of each steel mill installation. Because of the improvement in control technology, it is now possible to have in excess of twenty five mill stands operating in a single mill installation. Where present day rod exit speeds of 100 meters per second are not unusual, future mills are presently being planned where rod exit speeds approaching 150 meters per second will be encountered.

This means that all the rollers in the various mill stages will be subjected to increasing operating speeds and hence the pre spin velocity of each set of rollers of the roller entry guides must increase in a ratio directly proportional to the speed of the product passing there through.

For the final stage of a present day mill, a rod exit speed of 100 meters per second represents about 40 to 45,000 r.p.m. rotational speed of the guide rollers. For exit speeds of 150 meters per second, inlet guide rollers must achieve a pre spin velocity of about 60,000 r.p.m.

PRIOR ART

U.S. Pat. No. 4,295,356 Oct. 20, 1981

This patent shows a roller entry guide wherein the rollers are provided with a series of scoop-shaped recesses to provide a plurality of reaction surfaces for driving each roller with cooling fluid, usually water.

U.S. Pat. No. 4,373,367 Feb. 15, 1983

This patent is directed to an assembly for delivering pressurized fluid (usually water) through a guide bracket in such a manner that the pressurized fluid impinges upon the reaction surfaces (scoop-shaped recesses) at the proper angle to drive the rollers to a selected speed before the rod enters the guide.

SUMMARY OF THE INVENTION

The roller profile and shape is largely dictated by the shape of the work product passing between the rollers in the roller entry guide, thus the roller diameters (internal and external) are generally predetermined by constraints such as standardization and interchangability of various rollers.

This invention therefore has for its object the provision of rollers for roller inlet guides which will operate in present day roller guides at increased rod inlet speeds without any substantial modification to the roller inlet guide construction.

It is a further object of this invention to provide a roller for an inlet roller guide which has no preferential direction of rotation.

It is a further object of this invention to provide a roller for an inlet roller entry guide which provides a greatly increased reaction surface for impingement of the driving fluid thereon.

DESCRIPTION OF THE PREFERRED EMBODIMENTS

Figure 1:
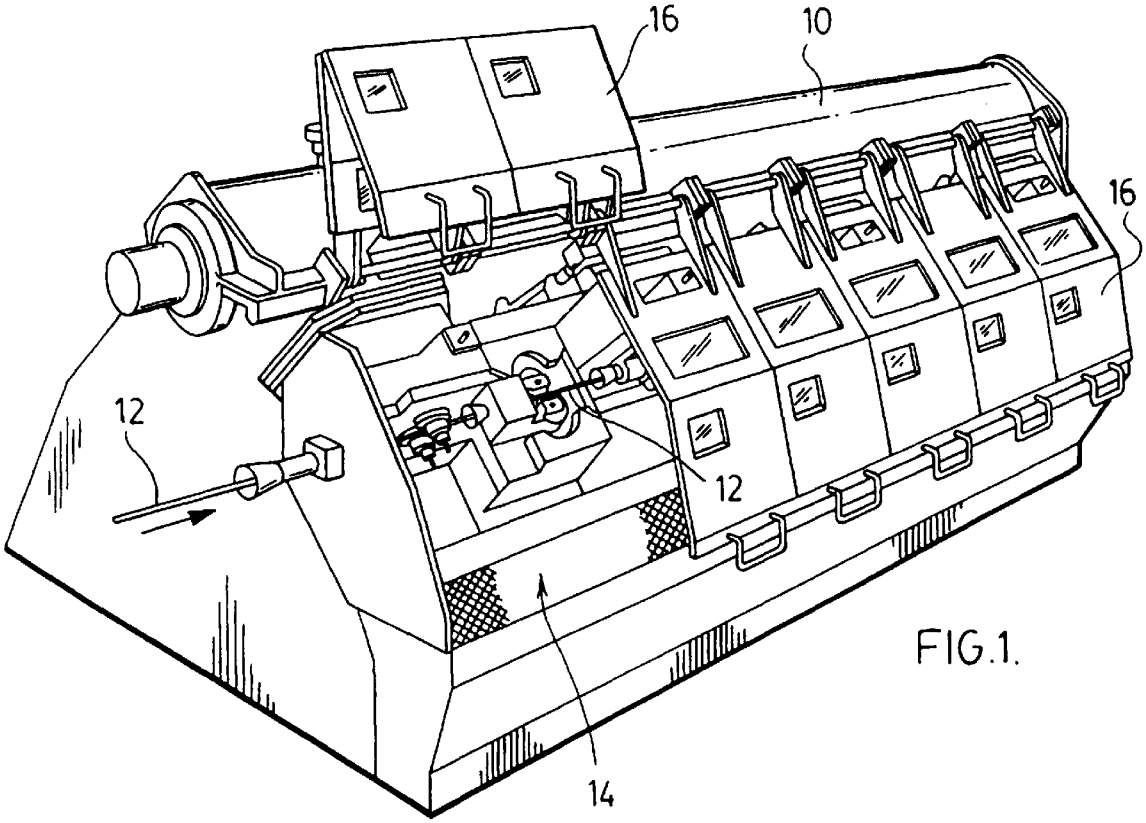
FIG. 1 is a perspective view of a rolling mill in which this invention is employed.

Referring to the drawings and FIG. 1 in particular, a steel mill 10 useful in processing steel billets into steel rods is shown in perspective. The steel mill 10 is equipped with a series of reducing stages, all in the same line, so that an incoming rod 12 is successively reduced as it passes through the various reducing mill stands such as the stage shown at 14. Safety covers 16 are provided to protect operating personnel from damage caused by the impact with fractured components etc. which may result from component failures during a reducing operation. The rod enters at the left side of the mill and exits from the right hand end of mill 10.

Figure 2:
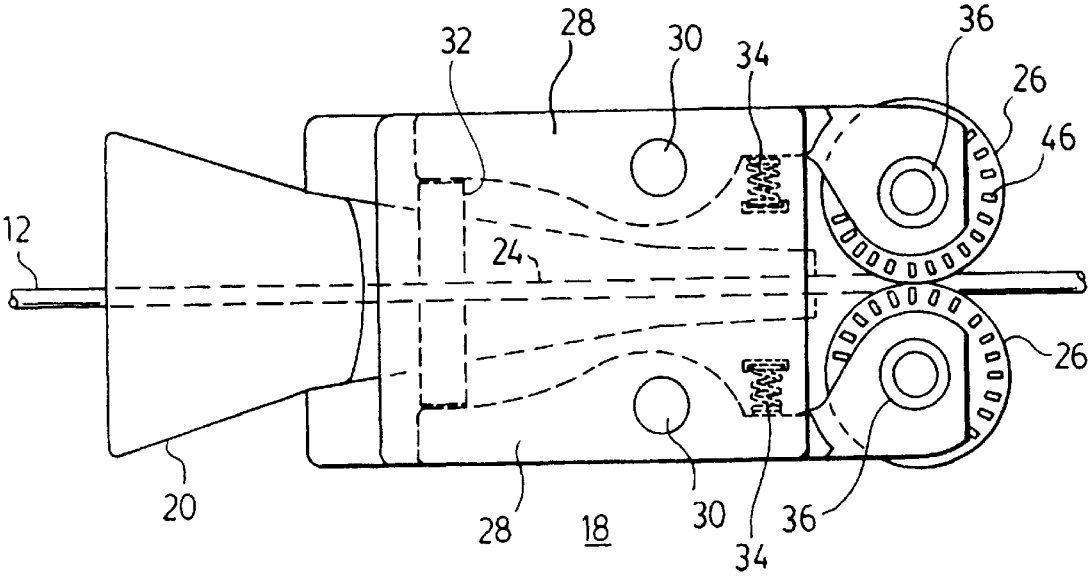
FIG. 2 is a representative view of a typical roller entry guide assembly which shows only the parts which are pertinent to this invention.

FIG. 2 shows a typical roller entry guide 18 utilizing the rollers of this invention. A funnel shaped input guide 20 provides the initial guiding mechanism for the rod 12 as it enters the roller entry guide 18. Rod 12 is thus directed into the bore 24 of guide 18. The rod 12 subsequently passes between a pair of driven guide rollers 26 and exits to a pair of reducing rolls, generally tungsten carbide (not shown) that reduce the cross section of the rod 12.

Each roller is mounted in a rocker arm 28 which is pivoted in the roller entry guide 18 on pins 30 which have axis in a spaced parallel relationship. The spacing between the rollers (bight) is made to be adjustable by means of a wedge device 32 mounted in entry guide 18 at a point opposite the pivot pins from the rollers 26 in the rocker arms 28. The rocker arms are constantly biased to their final operating position by springs 32 and 34 which tend to keep the rollers 26 at the maximum spacing permitted by wedge 32.

Figure 3:
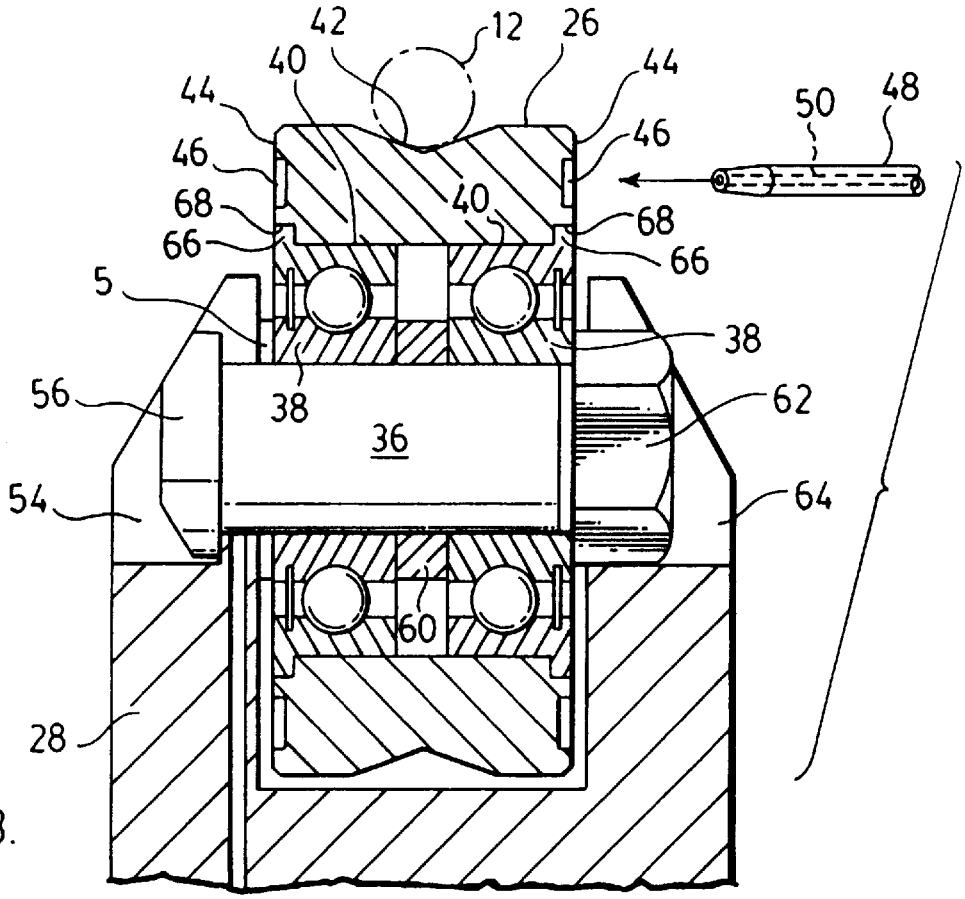
FIG. 3 is an enlarged sectional view of the roller assembly shown in FIG. 2.
Figure 4:
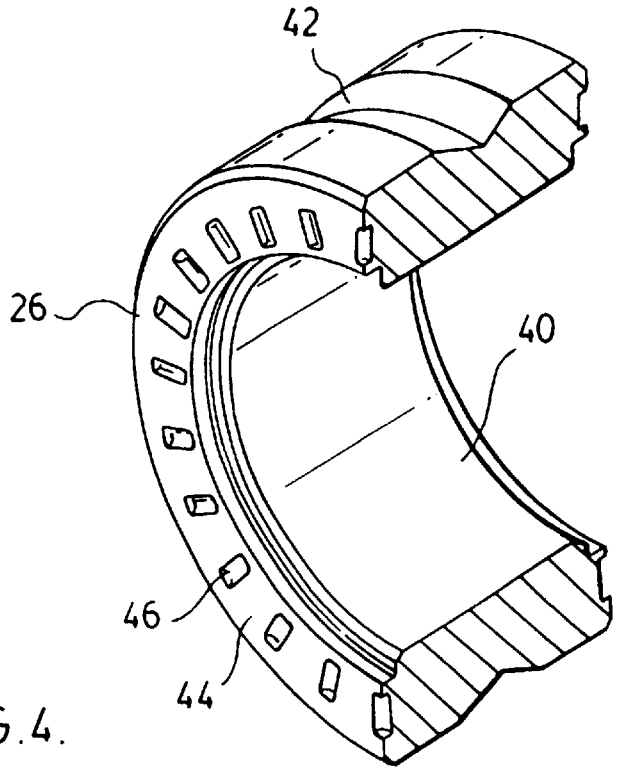
FIG. 4 is a partial perspective of the roller of this invention.

Each roller 26 is mounted in the respective rocker arms 28 on a bolt 36 on which are mounted a pair of bearings 38 (see FIG. 3), which engage the inner cylindrical surface 40 of the guide rollers 26. The rod engaging surface 42 of rollers 26 is contoured to specifications peculiar to the type of rod being reduced, as shown.

The sidewalls 44 of rollers 26 are provided with a plurality of spaced somewhat rectilinearly shaped pockets 46 which form the reaction surfaces used to drive the rollers 26.

Each arm 28 is provided with a nozzle 48 which allows the driving fluid to exit therefrom and impinge on rollers 26 at pockets 46.

Nozzle 48 is provided with a suitable bore 50 which is connected to a suitable supply of pressurized fluid and which is supplied to guide 18 to cool the guide, and cool and drive rollers 26.

Usually only one side of the rollers 26 is driven, but pockets 46 allow unlimited interchangability of rollers because of the shape chosen to react with the impinging fluid stream in either direction of rotation.

The detail of the mounting of the rollers 26 in the guide 18 is as follows:

Bolt 36 is mounted in guide 18 in recess 54 at the head end 56 of bolt 36. The bolt passes through a washer 58 and through the inner race of one of the bearings 38, through a second washer 60 and through a second inner race of bearing 32 to which is clamped nut 62.

Nut 62 is engaged by recess 64. Thus nut 62 clamps the whole roller and bearing assembly together and also stabilizes the threaded end of bolt 36 in guide 18.

Bearings 38 are provided with a peripheral lips 66 to engage annular recesses 68 on the inner surface of roller 26. Thus the lips 66 and recesses 68 combine with spacer 60 to accurately mount each roller 26 in the guide 18.

Previous rollers have been capable of being driven in one direction only, and the repeated impingement of the working surfaces of the rollers 26 causes abrasion and wear which is peculiar to the direction of rotation. Reversal of rotation of the rollers can lead to increased life and diminished operating costs for the reducing mill.

It will become apparent that the pockets 46 in rollers 26 may be spaced much closer than pockets shown in the prior art entry guides. The addition of the extra pockets in the rollers 26 allows each roller to present more reaction surfaces to the impinging fluid stream and thus achieve a higher rotational velocity for increasing rod entry speeds.

Pockets 46 in rollers 26 of this invention relieve the steel mill operators and maintenance personnel of the problem of improper installation of inlet guide rollers of the prior art which were sensitive to the direction of the rotation.

What is claimed is:

1. A roller entry guide for a rod mill comprising:

a body having a passageway formed therein for guiding the passage of a rod as it passes therethrough, a pair of pivoting arms mounted on said body on opposing sides of the rod passageway, a pair of reversible roller guide members mounted on said pivoting arms at the ends thereof for engaging said rod as it passes through said guide, means to direct a stream of high speed fluid onto said roller guide members in such a manner as to cause rotation of said roller guide members, each of said roller guide members having a plurality of fluid reaction pockets arranged in a ring on each roller guide member, said pockets being in the form of a slightly rounded parallelapiped.

2. A roller entry guide as claimed in claim 1 wherein said roller guide members are substantially annular shaped, having an internal aperture of such shape as to receive bearing means, and wherein each roller guide member has an external surface profile suitable for engaging said rod and wherein each roller has a pair of opposing flat annular surfaces extending between said internal aperture and said external surface profile, wherein a plurality of evenly radially spaced substantially rectangularly shaped pockets are formed at a constant diameter of said annular surface.

3. A reversible roller guide as claimed in claim 1 wherein said roller guide members are substantially annular shaped, having an internal aperture of such shape as to receive bearing means, and wherein each roller guide member has an external surface profile suitable for engaging said rod and wherein each roller has a pair of opposing flat annular surfaces extending between said internal aperture and said external surface profile, wherein a plurality of evenly radially spaced substantially rectangularly shaped pockets are formed at a constant diameter of said annular surface.

4. A reversible roller guide as claimed in claim 1 wherein said roller guide members are substantially annular shaped, having an internal aperture of such shape as to receive bearing means, and wherein each roller guide member has an external surface profile suitable for engaging said rod and wherein each roller has a pair of opposing flat annular surfaces extending between said internal aperture and said external surface profile, wherein a plurality of evenly radially spaced substantially rectangularly shaped pockets are formed at a constant diameter of said annular surface.

5. A reversible roller guide as claimed in claim 1 wherein said roller guide members are substantially annular shaped, having an internal aperture of such shape as to receive bearing means, and wherein each roller guide member has an external surface profile suitable for engaging said rod and wherein each roller has a pair of opposing flat annular surfaces extending between said internal aperture and said external surface profile, wherein a plurality of evenly radially spaced substantially rectangularly shaped pockets are formed at a constant diameter of said annular surface.

6. A reversible roller as claimed in claim 5 wherein said parallelapiped has corners which are slightly rounded.

* * * * *